US005572820A

United States Patent [19]

Mallory

[11] Patent Number: 5,572,820

[45] Date of Patent: Nov. 12, 1996

[54] EMERGENCY KIT

[75] Inventor: John W. R. Mallory, Chatham, Canada

[73] Assignee: Mallory Industries Inc., Blenheim Ontario, Canada

[21] Appl. No.: 390,085

[22] Filed: Feb. 17, 1995

[51] Int. Cl.[6] ..... G09F 21/04

[52] U.S. Cl. ..... 40/591; 40/611; 206/573; 206/575; 206/803

[58] Field of Search ..... 40/591, 593, 611; 15/236.02; 206/573, 575, 803

[56] References Cited

U.S. PATENT DOCUMENTS

| | | | |
|---|---|---|---|
| D. 170,460 | 9/1953 | Hauser . | |
| D. 344,825 | 3/1994 | Cummings et al. . | |
| 1,520,113 | 12/1924 | Bloom | 40/492 X |
| 2,770,826 | 11/1956 | Curfman | 15/236.02 X |
| 4,141,111 | 2/1979 | Hopkins et al. | 15/236.02 |
| 4,164,801 | 8/1979 | Thomas | 15/236.02 |
| 4,471,873 | 9/1984 | Thomas | 40/591 X |
| 4,538,320 | 9/1985 | Batt | 15/236 R |
| 5,333,342 | 8/1994 | Huang | 15/236.02 X |
| 5,357,646 | 10/1994 | Kim | 15/236.02 X |

FOREIGN PATENT DOCUMENTS

| | | | |
|---|---|---|---|
| 9112981 | 9/1991 | WIPO | 15/236.02 |

OTHER PUBLICATIONS

Product literature for "Big Max" and Snowbuster (Brushcraft, 2 pages).

Product literature for "Venus II" (Raywares Ltd. 1 page).

Product literature for "Ice Mitt", Ice Shooter and Blizzard (Mastermotive, 1 page).

Product literature for "Ice Breakers" (Wescon, 2 pages).

Product literature for "Ice Scrapers" (Detailed Design, 3 pages).

Product literature for "Ice Device" (North Sales, 1 page).

Product literature for "Bear Paw" (1 page).

Product literature for "Super Deluxe Snowbrush" and Cub Lighted Ice Scraper (Hoppy, 2 pages).

Product literature for "Ice Scrapers" (Mallory, 1 page).

Product literature for "Red Alert 'Call Police' Emergency Flag" (Scouts Canada, 1 page).

*Primary Examiner*—Brian K. Green

*Attorney, Agent, or Firm*—Fish & Richardson P.C.

[57] ABSTRACT

A roadside emergency kit that is compact, simple to store, reusable and readily available in times of emergency, for use in a motor vehicle. The kit incorporates a brightly coloured signalling banner with a compact storage device and a device for cleaning the windows of the vehicle. The signalling banner is foldable and may be mounted on the interior of a vehicle window. It can be stored easily in the storage device. The storage device is incorporated in a device that may also be used for cleaning the window, such as an ice scraper. The signalling banner can be made highly visible in less than ideal weather conditions by utilizing the cleaning device to clean the outer side of the vehicle window.

5 Claims, 2 Drawing Sheets

EMERGENCY KIT

BACKGROUND OF THE INVENTION

This invention relates to an emergency roadside kit for use in motor vehicles.

1. Description of the Prior Art

Numerous device and kite for use in case of vehicle emergencies are known in the prior art. Such devices are typically designed for use by motor vehicle operators in cases where such operator are stranded because of vehicle failure. The devices generally serve the purpose of signalling passing traffic or the vehicle operator's plight. In this way, passing traffic can avoid colliding with a stopped vehicle, assist the operator, or call for emergency help.

Typical devices disclosed by the prior art incorporate luminescent devices such as lights an flares. These luminescent devices are typically placed some distance from the stopped vehicle and are activated to give off a signal, warning oncoming traffic of the stopped vehicle. Often the devices are battery powered and can also be placed in, on, or in close proximity to the vehicle. Other devices employ pyrotechnology such as flares and must thus be placed at some distance from the stopped vehicle to avoid harm to the vehicle.

These types or devices suffer from the drawbacks that they are often not reusable, bulky and difficult to store. Moreover, such devices often may not be stored indefinitely in order to remain effective in case of an emergency. Battery supplies and lighting material may wear out through attrition and may thus not function in the event of a true emergency. Similarly, battery supplies and lighting material may need to be replaced after each use. In addition, the storage of such luminescent devices may be difficult because of their size. A vehicle's own flashing emergency or hazard lights will, after a limited period of time, dim and eventually be extinguished once the vehicle's battery is exhausted.

Other emergency signalling devices known include signs or banners to be mounted on the interior of the vehicle in case of an emergency. Such devices are often significantly smaller and simpler to store than the previously discussed luminescent devices. Nevertheless, without a proper storage medium such signs and banners are often damaged or stored improperly or inaccessibly. Furthermore, as such devices are mounted on the interior of the stopped vehicle, they are often not visible to passing traffic. This problem in exacerbated in less than ideal weather conditions with limited visibility. Moreover, in winter weather the sign or banner may become completely invisible as the vehicle windows become covered with snow and ice.

SUMMARY OF THE INVENTION

I have found that many of the disadvantages of the prior art may be overcome by the present invention. It is an object of this invention to provide for an effective roadside emergency kit that in compact, simple to store, reusable and readily available in times of emergency. This object is achieved by a kit incorporating a brightly coloured signalling banner with a compact storage device and a device for cleaning the windows of the vehicle. By using a bright, roadside signalling banner which can be mounted on the interior of a vehicle, the kit requires no external energy source and is reusable. The signalling banner can be folded and stored easily. Moreover, by providing a device that may also be used for cleaning the window, such as an ice scraper, the roadside kit is extremely effective, the signalling banner can be made highly visible in less than ideal weather conditions by utilizing the cleaning device to clean the outer window.

According to one aspect of the invention, there is provided an emergency kit comprising a signalling banner, having attachment means for mounting the banner on an interior surface of a vehicle window and a window cleaning device having a cleaning element adapted for use in cleaning an exterior surface of the window. The handle is proximate to the cleaning element and has an aperture extending into a cavity deposed in the handle which defines a storage compartment to receive and store the banner According to another aspect or the invention, there is provided a method or dispatching an emergency signal from a vehicle utilizing an emergency kit. The kit comprises a signalling banner, having attachment means for mounting the banner on an interior surface of a window of a vehicle, a window cleaning device further having a cleaning element adapted for use in cleaning an exterior surface of said window and a handle attached to the cleaning element having an aperture extending to a cavity deposed in the handle defining a storage compartment to receive and store the banner. The cleaning element is comprises of a scraper blade and the handle is comprised of a hollow tube having an aperture on one end. The scraper blade extends from another end of the tube. The kit further comprises a cap that is removably adapted to engage the tube to cover the aperture and seal the cavity, The method comprises the steps of removing the cap from the handle; removing the banner from the cavity, unrolling the banner; mounting the banner on the interior of a vehicle window; and cleaning an exterior of the window using the cleaning device. Alternatively, one may clean the exterior of the window prior to mounting the banner on the interior of the window.

In drawings which illustrate a preferred embodiment of the invention.

DETAILED DESCRIPTION OF THE PREFERRED EMBODIMENT

Figure 1:
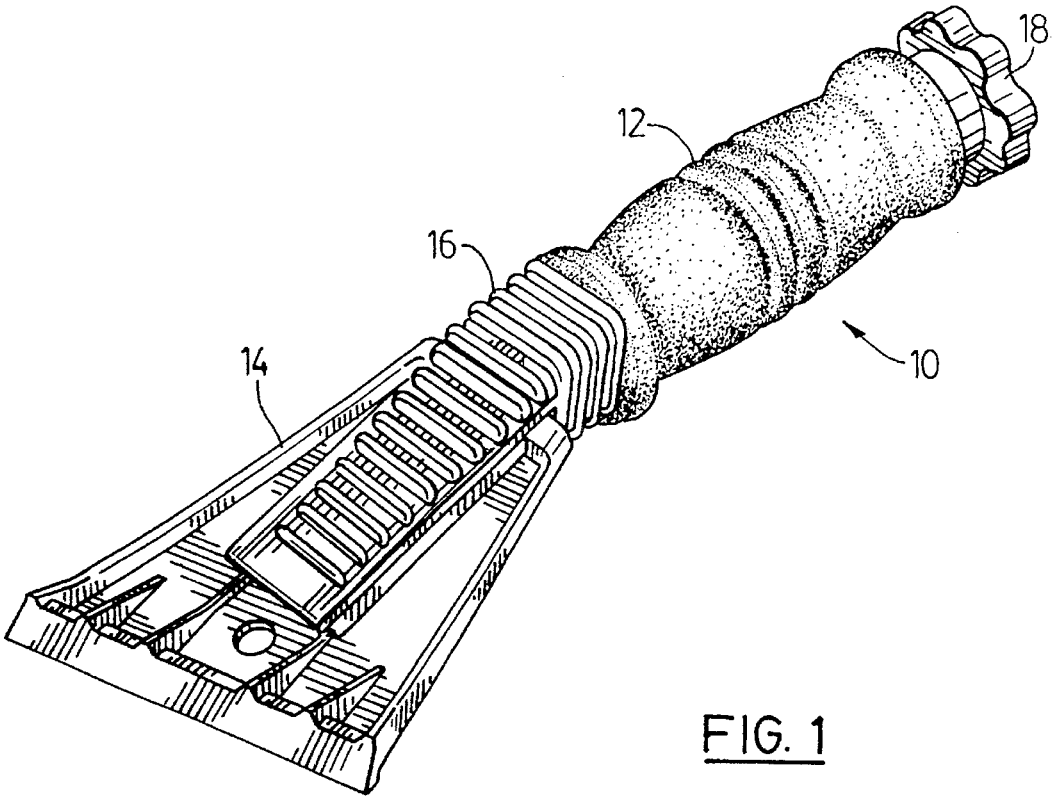
FIG. 1 is a drawing of the assembled kit.

FIG. 1 illustrates an assembled kit, having the appearance of an ice scraper 10 having a handle 12, and a scraper blade 14. A connector 16 extends from one end of the handle 12 and engages the scraper piece 14. A cap 18 covers the other end of the handle 12. The connector 16 and the scraper blade 14 are made of a rigid plastic.

Figures 2, 3:
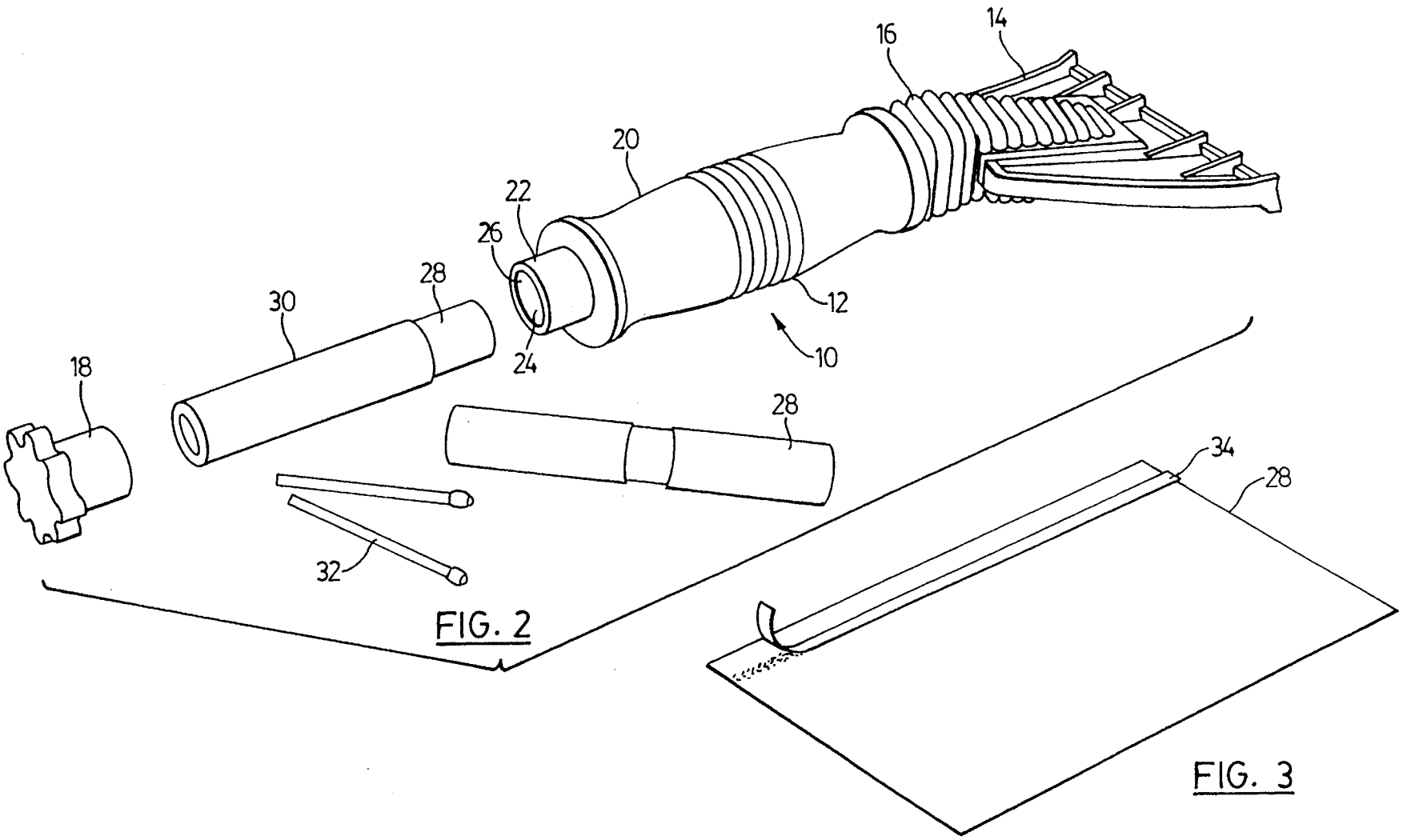
FIG. 2 shows the constituent elements of the kit.
FIG. 3 is a drawing of the signalling banner.

As can be seen from FIGS. 1 and 2 the handle 12 of the ice scraper 10 has an outer covering 20 made of a sponge-like material and an inner tube 22 extending longitudinally in the handle. The tube 22 in made of metal and has an aperture 24 at one end, leading to a cavity 26 deposed within the tube 22. Cavity 26 longitudinally extends from aperture 24 toward scraper blade 14 and is circular in cross-section. The cap 18 covers one end of the handle by engaging the tube 22 to cover the aperture 24 and may be removed to provide access to the cavity 26. A signalling banner 28 may be stored in rolled fashion in the cavity 26 by placing the banner 28 in a banner holder 30. The banner holder 30 provides sufficient space for the storage of matches 32. In other embodiments, the cavity 26 may be adapted to hold other items for signalling such as a candle, a small flashlight or a whistle. Alternatively, the kit may include in one embodiment a folded piece of heat retaining material. Furthermore the kit may include an instruction sheet to provide a user with details of how to use the kit's components.

As can be see from FIGS. 2 and 3, the signalling banner 28 may be roiled up for storage in the cavity 26 and may be unrolled for use. In an unrolled position its shown in FIG. 3, an adhesive strip 34 is visible on at least one side of the banner 28.

In the case of an emergency, the kit may be disassembled. The cap 10 must first be removed from the tube 22. Thereafter, the banner holder 30 and the banner 28 are removed from the cavity 26. The banner 28 is then unrolled or unfolded and attached by means of the adhesive strip 34 to the interior side or a vehicle window 36. The kit user may then exit the vehicle and use the ice scraper 10 to remove ice and snow or otherwise clean the exterior side of the window 36 to makes the banner 28 visible on the exterior of the vehicle.

Figure 4:
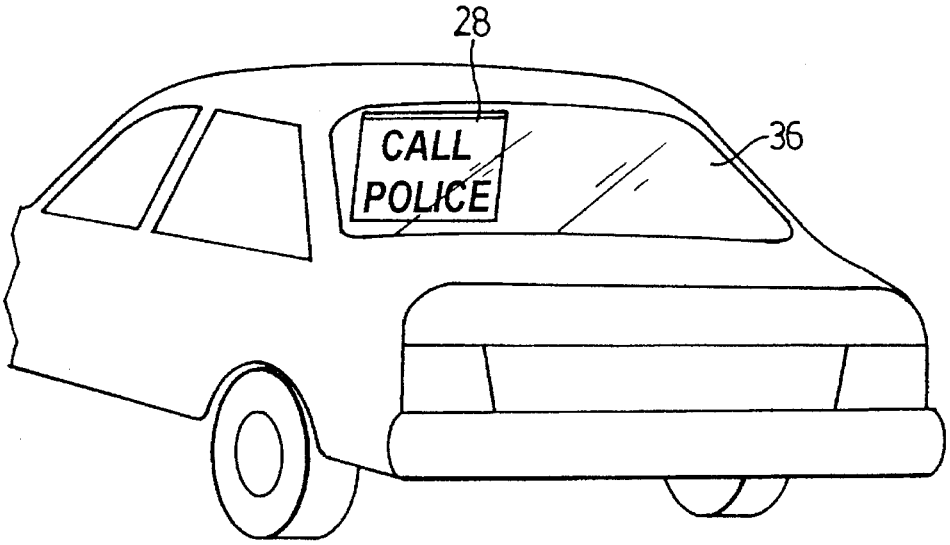
FIG. 4 is a drawing of a vehicle equipped with the present invention.

FIG. 4 depicts the kit in use, with the banner 28 mounted on the interior or a vehicle window 36. It will be appreciated that the preferred embodiment incorporates a scraper blade 14 which may be replace by another window cleaning device such as a brush or squeegee. The tube 22, cavity 26 and handle 12 described need not be cylindrical. Moreover, the handle 12, the tube 22 and the cleaning device may be integrally formed, all from plastic. Various other modification of the invention are possible. For example, the banner 28 may be adapted for mounting on the exterior of the window 36, requiring the window 36 to be cleaned prior to mounting. The attachment of the banner to the window may be other than by an adhesive strip. For example, the banner may be made from a material, such as a plastic film, that has electrostatic properties for bonding with a window surface.

I claim:

1. An emergency signalling kit comprising:

a foldable signalling banner having indicia thereon and mountable on a vehicle window;

a window cleaning device comprising:

a cleaning element having a generally straight forward edge for use in cleaning an exterior surface of said vehicle window;

an elongated handle extending longitudinally from said cleaning element and said handle having a length and a width;

said handle having an aperture extending to a cavity deposed in said handle defining a storage compartment to receive and store said banner.

2. A kit as claimed in claim 1 wherein said banner comprises attachment means for mounting said banner on an interior surface of said vehicle window.

3. A kit as claimed in claim 2 wherein said handle comprises a hollow tube having first and second ends, and said aperture being located at said first end of said tube, and said cleaning element extends from said second end of said tube.

4. A kit as claimed in claim 3 further comprising a cap removably adapted to engage said tube to cover said aperture and seal said cavity.

5. A method of dispatching an emergency signal from a vehicle utilizing an emergency kit, said emergency kit comprising a foldable signalling banner having attachment means for mounting said banner on a vehicle window a window cleaning device further comprising a cleaning element for cleaning a surface of said vehicle window;

a handle attached to said cleaning element said handle comprising a hollow tube having an aperture extending from one end into a cavity deposed in said handle, said cavity defining a storage compartment to receive and store said banner;

a cap adapted to removably engage said tube to cover said aperture and seal said cavity;

said cleaning element extending from an end of said tube opposite said aperture said window comprising an interior surface and an exterior surface opposite said interior surface;

said method comprising the steps of removing said cap from said tube;

removing said banner from said cavity;

unfolding said banner;

mounting said banner on said interior surface of said vehicle window;

cleaning said exterior surface of said window using said cleaning device.

* * * * *